United States Patent [19]

Yoshida et al.

[11] 4,006,106

[45] Feb. 1, 1977

[54] SELF SEALABLE GLASSY RESISTOR COMPOSITION FOR A RESISTOR SEALED SPARK PLUG

[75] Inventors: Mitsutaka Yoshida, Chita; Masao Sakai, Kasugai, both of Japan

[73] Assignee: NGK Spark Plug Co., Ltd., Nagoya, Japan

[22] Filed: Sept. 29, 1975

[21] Appl. No.: 617,596

[30] Foreign Application Priority Data

Oct. 8, 1974 Japan ..... 49-115145

[52] U.S. Cl. ..... 252/513; 252/512; 252/516; 252/517; 252/521

[51] Int. Cl.[2] ..... H01B 1/02; H01B 1/04; H01C 1/02; H01C 1/04

[58] Field of Search ..... 252/512, 513, 516, 517, 252/521; 106/46

[56] References Cited

UNITED STATES PATENTS

| | | | |
|---|---|---|---|
| 3,484,284 | 12/1969 | Dates et al. | 252/513 |
| 3,680,029 | 7/1972 | Berry | 252/513 |
| 3,875,477 | 4/1975 | Fredickson et al. | 252/516 |

*Primary Examiner*—Benjamin R. Padgett
*Assistant Examiner*—Josephine Lloyd
*Attorney, Agent, or Firm*—Stevens, Davis, Miller & Mosher

[57] ABSTRACT

A self sealable glassy resistor composition for a resistor sealed spark plug consists essentially of 5–40% by weight of at least one of the resistance value stabilizing component selected from the group consisting of oxides of metals of Groups IVb and Vb of the Periodic Table and rare earth metals, $ThO_2$ and SiC, a water soluble carbonaceous material of saccharides or aliphatic hydrocarbons in such an amount that 0.1–5.0% by weight of carbon value is contained in the final composition, 35–85% by weight of borosilicate glass powder, 5–25% by weight of at least one of metals or alloys thereof, the melting point of which is higher than the glass seal temperature and 2–20% by weight of at least one of metals or alloys thereof, the melting point of which is lower than the glass seal temperature, provided that the total amount of both the higher melting point metals or alloys and the lower melting point metals or alloys is up to 30% by weight. The properties of the self sealable glassy resistor composition can be improved by additionally adding 0.1–20 parts by weight based on 100 parts by weight of the self sealable glassy resistor composition, of at least one of the carbides of Ti, Zr, V, Nb, Ta, Cr, Mo, W, B and Th.

3 Claims, No Drawings

SELF SEALABLE GLASSY RESISTOR COMPOSITION FOR A RESISTOR SEALED SPARK PLUG

The present invention relates to a self sealable glassy resistor composition for a resistor sealed spark plug and particularly the glassy resistor composition, by the glass seal of which the mechanism adhesive strength of a center electrode and a terminal screw can be advantageously improved.

It has been attempted to prevent wave disturbance and noises by sealing a resistor in series to the discharge gap between a center electrode and a terminal screw in the axial hole of a ceramic insulator of a spark plug for an internal combustion engine, particularly for automobiles and in this case the resistor is sealed and fixed by an electrical conductive glass seal which bonds the center electrode and the terminal screw electrically conductively and the conductive glass seal is usually composed of copper powder and glass in a mixture ratio of 1:1.

It has been attempted to omit the electrically conductive glass and to directly melt bond a resistor material to both the center electrode and the terminal screw but the resulting spark plug has not been satisfactory in view of the heat stability and the durable life property under load of the spark plug as explained hereinafter and has been insufficient in the sealing property and such a spark plug has never been practically used. This is because the above described resistor materials are mainly glass-aggregate-carbon systems or glass-$TiO_2$-$B_4C$ systems and these materials are poor in wetting to the center electrode and the terminal screw composed of Ni, Fe or Cu upon the heat melting bond and a satisfactory adhesion cannot be obtained.

The term "heat stability" used herein follows the heat test of resistor of JIS D5102-1960, item 4.4.12 and means the variation percentage of resistance value before and after heating when the resistor composition of a sealed spark plug is heated at 300° C in air for 20 minutes and then left to stand at room temperature for 30 minutes.

The term "durable life property under load" follows JIS D5102-1960, item 4.4.11 and is defined by the following formula. That is, the resistance value ($R_1$) is first measured in air at room temperature under normal moisture and then the spark plug is applied 800 times spark per minute for 250 hours and is left to stand for 1 hour and then the resistance value ($R_2$) is measured.

Durable life property under load $= (R_2 - R_1)/R_1$

When the spark plug is sealed with the electrically conductive glass as described above, the spark plug is assembled by dividing and charging the electrical conductive glass powder in two layers above and below the resistor material powder into a narrow axial hole of a ceramic insulator, so that the working step is complicated and further the material powders to be charged in three layers must be strictly weighed and the electrically conductive glass layers occupy the inner space of the axial hole of the ceramic insulator and limit the axial length of the resistor to be charged, so that the applicant's attempt (Japanese laid open specification 45,725/73) to considerably improve the noise preventing ability by making the length of the resistor more than 7 mm, has not been favorably accomplished.

The present invention has developed a novel glassy resistor composition by which the center electrode and the terminal screw are electric conductively bonded and sealed with the resistor itself without particularly using the electrically conductive glass in the same melt bonding process under heating pressure as in the conventional melt bonding by means of an electrically conductive glass, whereby the wave disturbance and noises can be prevented effectively for a long time by the sealed resistor and the mechanical adhesive strength between the center electrode and the terminal screw of the spark plug can be advantageously improved.

In the present invention, it has been found that for the base component composing the sealing resistor, in order to improve the adhesion of the center electrode and the terminal screw to borosilicate glass, it is effective that 5–25% by weight of at least one of metal or alloy powder, the melting point of which is higher than the glass seal temperature, for example, iron or the alloy thereof, such as Fe, Fe—B, Fe—Ti or non-iron metal or the alloy thereof, such as Cu, Ni, Cr, Mn or Ni—Cr, and 2–20% by weight of at least one of metal or the alloy powder, the melting point of which is lower than the glass seal temperature, for example non-iron metal or the alloy thereof, such as Sn, Sb, Zn, Al , Pb, Te, Cu-Sn or Cu-Zn are included, provided that the total amount of both the metals or alloys of the higher and lower melting point is up to 30% by weight.

In the sealing resistor base components, at least one of water soluble carbonaceous materials, such as saccharides, aliphatic hydrocarbons and the like as a resistance value controlling component and at least one of oxides of metals of Groups IVb and Vb, such as Ti, Zr, Hf, V, Nb, Ta and the like, oxides of rare earth metals, $ThO_2$ and SiC as a resistance value stabilizing component are compounded in the specifically defined ratios.

The present invention consists in a self sealable glassy resistor composition of a resistor sealed spark plug consisting essentially of 5–40% by weight of at least one of the resistance value stabilizing components selected from the group consisting of oxides of metals of Groups IVb and Va of the Periodic Table and rare earth metals, $ThO_2$ and SiC, a water soluble carbonaceous material of saccharides or aliphatic hydrocarbons in such an amount that 0.1-5.0% by weight of carbon value is contained in the final composition, 35–85% by weight of borosilicate glass powder, 5-25% by weight of at least one of metals or alloys thereof, the melting point of which is higher than the glass seal temperature and 2–20% by weight of at least one of metals or alloys thereof, the melting point of which is lower than the glass seal temperature, provided that the total amount of both the higher melting point metals or alloys and the lower melting point metals or alloys is up to 30% by weight.

When the glassy resistor composition of the present invention is utilized for the resistant bond of the center electrode and the terminal screw in the axial hole of the ceramic insulator of the spark plug, the required properties can be attained in a high degree without using the electrically conductive glass and further the sealing adhesive strength to the center electrode and the terminal screw can be improved.

In the present invention, a further addition of at least one of carbides of Ti, Zr, V, Nb, Ta, Cr, Mo, W, B and Th facilitates the control of the resistance value and stabilizes the durable life property under load.

In the present invention, as the carbonaceous materials, carbon black and graphite are not preferable in view of the mutual dispersion to the other components and the unevenness of the resistance value due to the nonumiform dispersion and hence the water soluble carbonaceous materials, preferably saccharides, such as sucrose, lactose, maltose, raffinose, glucose, xylose, dextrine, methyl cellulose and the like and aliphatic hydrocarbons, such as ethylene glycol, glycerine, propylene glycol, polyethylene glycol, polyvinyl alcohol and the like are used.

The reason why the additional amount of the oxides of metals of Groups IVb and Vb of the Periodic Table and rare earth metals, $ThO_2$ and SiC as the resistance value stabilizing component is limited to be 5–40% by weight based on the base components is as follows. These compounds show the same effect in the stabilization of the heat property of the resistor sealed spark plug and further act to direct the durable life property under load in the negative direction. However, when the amount is less than 5% by weight, the required properties cannot be obtained in both the heat stability (within ±25%) and the durable life property under load (within ±30%) and furthermore the resistance value may be too large. On the other hand, when the amount is more than 40% by weight, the durable life property under load exceeds −30% and the temperature coefficient of the resistance value is deteriorated, the relative amount of the glass component becomes too small, the quality of the sealed resistor becomes porous, the air-tightness becomes poor, it becomes difficult to soften such a composition and the insertion of the terminal screw becomes difficult.

When the amount of carbon in the final composition formed from the water soluble carbonaceous material is less than 0.1% by weight, the resistance value becomes too large and such a composition is not preferable for use, while when the amount exceeds 5% by weight, the resistance value becomes too small and such a composition also cannot be used. This carbonaceous material determines the resistance value of the resistor together with the metal or alloy powders as mentioned hereinafter but when it is intended to determine the resistance value only by the metal or alloy powders, the unevenness of the resistance value becomes considerable and further the resistance value varies rapidly depending upon the amount of metal added (when the content of the metal exceeds 30% by weight, the metal powders contact one another and the resistance value suddenly drops), so that the control of the resistance value becomes difficult. On the other hand, if the determination of the resistance value depends upon only the carbonaceous material, the resistance value varies continuously by the amount of the carbonaceous material added and the unevenness of the resistance value is small and hence the control of the resistance value becomes easy, while the adhesion to both the center electrode and the terminal screw is deteriorated and the heat stability is considerably deteriorated. When the carbon value obtained from the carbonaceous material is 0.1–5.0% by weight and the amount of the metal or alloy powder is within the specifically defined range, that is only by the combination of both the components, the required properties can be obtained.

As the glass powder, the borosilicate glass having the composition of 65% of $SiO_2$, 30% of $B_2O_3$ and 5% of PbO is preferable and the borosilicate glass is essential for attaining the adhesion and seal between the center electrode and the terminal screw through the resistor, but when the amount of the borosilicate is less than 35% by weight, the function for adhesion is poor, the resistor becomes porous, the air-tightness is not satisfied, the softening is difficult and the insertion of the terminal screw becomes difficult. When the amount is more than 85% by weight, the heat property is deteriorated and such a composition cannot be used.

When the higher melting point metal or alloy powder which is one component contributing to the stabilization of the heat property owing to the affinity to the center electrode and the terminal screw is less than 5% by weight, said effect is low and the heat property becomes too large and such a composition cannot be used. While, when the amount exceeds 25% by weight, the unevenness of the resistance value appears.

The lower melting point metal or alloy is effective as a component for improving the adhesion to the center electrode and the terminal screw when the amount is less than 2% by weight, while when the amount exceeds 20% by weight, the adhesive strength rather lowers and the durable life property under load exceeds ±30%.

The total amount of the higher melting point and lower melting point metals or alloys must not exceed 30% by weight, because the resistance value extremely lowers to less than 1Ω.

In order to prove the function of the lower melting point (compared with the glass seal temperature) metal or alloy which shows the effect for improving the sealing adhesive strength of the center electrode and the terminal screw, the following impactive vibration test under heating was made.

By using the test apparatus of JIS B8031-1968, item, 4.4.4 the top of the center electrode was subjected to impact at a rate of 400 times/min. while heating the tip of the center electrode at about 800° C by a burner and the looseness of the center electrode was determined at an interval of 5 minutes and the result is shown in the following Tables 1A and 1B.

The glass resistor composition used in this test was prepared as follows. 60% by weight of the borosilicate broadly used as the glass component for such a composition (65% by weight of $SiO_2$, 30% by weight of $B_2O_3$ and 5% by weight of PbO), 9% by weight of $TiO_2$ as the resistance value stabilizing component, 15% by weight of SiC, and methyl cellulose as the water soluble carbonaceous material in such an amount that the carbon value in the final composition is 1% by weight were mixed and then 85% by weight of the resulting mixture and 15% by weight of the metal powder as shown in the following table were compounded and the mixture was granulated into a grain size of 20–100 meshes. 0.7 g of the resulting granules was charged into an axial hole of a ceramic insulator of an 14 mm class spark plug in which a center electrode has been fixed and a terminal screw was forcedly inserted thereinto while heating at 930° C for 7 minutes to effect sealing through heat melting and a sealed resistor having a length of 8 mm was formed between the center electrode and the terminal screw.

Table 1A

| Sample No. | Higher melting point metal Fe (wt.%) | Lower melting point metal (wt.%) | | | | | | Impactive vibration test under heating Time causing looseness in center electrode (min) |
|---|---|---|---|---|---|---|---|---|
| | | Sn | Sb | Zn | Al | Pb | Te | |
| 1 | 10 | 5 | — | — | — | — | — | more than 90 |
| 2 | " | — | 5 | — | — | — | — | " |

Table 1A-continued

| Sample No. | Higher melting point metal Fe (wt.%) | Lower melting point metal (wt.%) Sn | Sb | Zn | Al | Pb | Te | Impactive vibration test under heating Time causing looseness in center electrode (min) |
|---|---|---|---|---|---|---|---|---|
| 3 | " | — | — | 5 | — | — | — | " |
| 4 | " | — | — | — | 5 | — | — | 45 |
| 5 | " | — | — | — | — | 5 | — | 40 |
| 6 | " | — | — | — | — | — | 5 | 50 |
| 7 | " | 2 | 2 | 1 | — | — | — | more than 90 |
| 8 | " | — | 2 | 2 | 1 | — | — | " |
| 9 | " | — | — | 1 | 2 | 2 | — | 45 |
| 10 | " | — | — | — | 1 | 2 | 2 | 45 |

The results when the higher melting point metal (Fe) and the lower melting point metal (Sn) exceed the upper and lower limits or the total amount of both the metals exceeds the upper limit but the amount of the glass is decreased or increased depending upon the metal amount and the other points follow in the same manner as described above, as shown in the following Table 1C.

Table 1C

| Sample No. | Glass (wt.%) | Metal (wt.%) Higher melting point Fe | Lower melting point Sn | Total | Impactive vibration test under heating Time causing looseness in center electrode (min) | Heat stability (%) | Remarks |
|---|---|---|---|---|---|---|---|
| 22 | 47 | 25 | 3 | 28 | 35 | +15 | |
| 23 | 45 | 27* | 3 | 30 | 35 | — | Resistance value becomes small. Cannot be used. |
| 24 | 45 | 8 | 20 | 28 | 40 | +14 | |
| 25 | 45 | 8 | 22* | 30 | 15* | +15 | |
| 26 | 55 | 5 | 15 | 20 | 65 | +21 | |
| 27 | 57 | 3* | 15 | 18 | 65 | +35* | |
| 28 | 63 | 10 | 2 | 12 | 30 | +8.5 | |
| 29 | 64 | 10 | 1* | 11 | 10* | +9.3 | |
| 30 | 43 | 25 | 7 | 32* | more than 90 | — | Resistance value becomes small. Cannot be used. |
| 31 | 43 | 12 | 20 | 32* | 40 | — | " |
| 32 | 68 | 5 | 2 | 7 | 30 | +20 | |

Beyond the defined range. Not suitable.

As seen from the above Tables 1A–1C, any one of the samples wherein the higher melting point metal powder and the lower melting point metal powder are compounded in ratios of 5–25% by weight and 2–20% by weight respectively, show more than 20 minutes in the impactive vibration test under heating and ±25% in the heat stability and show the satisfactory property in the resistance velue, but when the total amount of both the metals exceeds 30% by weight and the amount of each metal is beyond the above defined range, the desired properties cannot be obtained.

Then, the samples obtained by using the resistor compositions compounded the borosilicate ($SiO_2$: 65% by weight, $B_2O_3$: 30% by weight of PbO), SiC, TiC, the higher melting point metal (Fe), the lower melting point metal (Sn), the water soluble carbonaceous material (methyl cellulose) in the ratios as shown in the following Table 2 and treating the resulting composition in the same manner as described above, were measured regarding the impactive vibration test under heating and the heat stability and the obtained results are shown in the following Table 2.

Table 1B

| Sample No. | Higher melting point metal (wt.%) Fe | Fe-B | Fe-Ti | Cu | Ni | Cr | Mn | Ni-Cr | Lower melting point metal Sn (wt.%) | Impactive vibration test under heating Time causing looseness in center electrode (min) | Heat stability (%) |
|---|---|---|---|---|---|---|---|---|---|---|---|
| 11 | | 10 | | | | | | | 5 | more than 90 | +5.8 |
| 12 | | | 10 | | | | | | " | " | +7.2 |
| 13 | | | | 10 | | | | | " | " | +7.5 |
| 14 | | | | | 10 | | | | " | " | +8.4 |
| 15 | | | | | | 10 | | | " | " | +7.9 |
| 16 | | | | | | | 10 | | " | " | +9.4 |
| 17 | | | | | | | | 10 | " | " | +8.3 |
| 18 | 5 | | | | | 5 | | | " | " | +5.9 |
| 19 | | 5 | | | 5 | | | | " | " | +6.1 |
| 20 | | | 5 | | | | 5 | | " | " | +8.0 |
| 21 | | | | 5 | | | | 5 | " | " | +9.5 |

Table 2

| Sample No. | Composition (wt.%) Boro-silicate glass | SiC | $TiO_2$ | Higher melting point metal powder Fe | Lower melting point metal powder Sn | Carbo-naceous material (methyl cellulose) | Impactive vibration test under heating Time causing looseness in center electrode (min) | Heat stability (%) | Remarks |
|---|---|---|---|---|---|---|---|---|---|
| 33 | 33* | 46* | 0 | 15 | 5 | 1.0 | 25 | —* | The formed resistor is porous and there is a fear of leakage of air-tight. The softening is difficult and the insertion of the terminal screw is difficult. The temperature coefficient of resistance value is deteriorated |
| 34 | 35 | 44* | 0 | 15 | 5 | 1.0 | 25 | +16 | and the durable life property under load exceeds −30%. |
| 35 | 60 | 24 | 0 | 10 | 5 | 1.0 | more than 90 | +8.3 | |
| 36 | 85 | 7.0 | 0 | 5 | 2 | 1.0 | 30 | +21 | |
| 37 | 87* | 5 | 0 | 5 | 2 | 1.0 | 25 | +33* | The durable life property under load is more than +301. Not suitable. |
| 38 | 78 | 0* | 0 | 15 | 5 | 2.0 | 80 | +51* | " |
| 39 | 75 | 3* | 0 | 15 | 5 | 2.0 | 80 | +35* | " |
| 40 | 75 | 5 | 0 | 13.5 | 5 | 1.5 | more than 90 | +25 | " |
| 41 | 50 | 40 | 0 | 6 | 3 | 1.0 | 45 | +13 | |
| 42 | 47 | 43* | 0 | 6 | 3 | 1.0 | 45 | +13 | The temperature coefficient of resistance value is deteriorated and the durable life property under load exceeds −30%. |
| 43 | 70 | 0 | 5 | 15 | 8 | 2.0 | more than 90 | +21 | |
| 44 | 70 | 0 | 10 | 15 | 4 | 1.0 | " | +18 | |
| 45 | 44 | 0 | 40 | 10 | 5.5 | 0.5 | " | +18 | |
| 46 | 41 | 0 | 43* | 10 | 5.5 | 0.5 | " | +19 | The temperature coefficient of resistance value is deteriorated and the effect for preventing noises is deteriorated. |
| 47 | 60 | 20 | 5 | 10 | 4 | 1.0 | 60 | +5.1 | |
| 48 | 60 | 25 | 0 | 10 | 5 | 0* | more than 90 | — | Resistance value is large. Cannot be used. |
| 49 | 60 | 24.9 | 0 | 10 | 5 | 0.1 | " | +17 | |
| 50 | 70 | 12 | 0 | 8 | 5 | 3 | " | +20 | |
| 51 | 70 | 12 | 0 | 7 | 3 | 5 | 45 | +24 | |
| 52 | 70 | 10 | 0 | 7 | 3 | 7* | 45 | — | Resistance value is small. Cannot be used. |

Beyond the defined range. Not suitable.

In the above described examples, $TiO_2$ was used as the oxide of the resistance value stabilizing component but any one of the oxides of the metals of Groups IVb and Vb of the Periodic Table and rare earth metals, $ThO_2$ and SiC showed the equivalent effect to $TiO_2$ and were substantially the same in the impactive vibration test under heating as in $TiO_2$. The following Table 3 shows the properties when 20% by weight of the other oxides was used as the resistance stabilizing component instead of 20% by weight of $TiO_2$.

Thus, according to the present invention, the electrically conductive glass layer for the electrically conductive seal which has been essential in the conventional resistor sealed spark plug, is not needed and it has now become possible that the sealed resistor itself serves as the electrically conductive cnnection between the center electrode and the terminal screw and the air-tight seal having a high adhesive strength in the axial hole of the ceramic insulator. Accordingly, the assembling step of the spark plug can be simplified and further the length of the resistor in the axial direction can be substantially extended, so that the formation of wave disturbance and noises can be effectively prevented.

Furthermore, the resistor composition of the present invention can be used as a substitute of the electrically conductive seal material for the carbonaceous resistor sealed in the axial hole by the electrically conductive seal material (glass:Cu=1:1) and in this case, the resistor composition can extend advantageously the total length of the sealed resistor as an assistant resistor connecting to the carbonaceous resistor in series.

That is, on the upper side and the lower side of 0.3 g of a carbonaceous resistor material composed of 25% by weight of glass of $BaO-B_2O_3$ (36:65), 35% by weight of clay, 35% by weight of zirconium and 5% by weight of glycerine, were charged respectively 0.25 g and 0.15 g of the self sealable resistor composed of 60% by weight of lead borosilicate glass, 15% by weight of SiC, 9% by weight of $TiO_2$, 10% by weight of Fe, methyl cellulose in such an amount that the carbon value in the final composition is 1% by weight, and 5% by weight of Sn and then the center electrode and the terminal screw were melt bonded in an axial hole of a ceramic insulator by heating at 950° C for 7 minutes under pressure. Then, the above described heat impact test was carried out and the looseness of the center electrode was not found after the test of 90 minutes.

Table 3

| Sample No. | Boro-silicate glass (wt.%) | Resistance value stabilizing component (wt.%) | | Higher melting point metal powder Fe (wt.%) | Lower melting point metal powder Sn (wt.%) | Carbona-ceous material (methyl cellulose) (wt.%) | Impactive vibration test under heating time causing looseness in center electrode (min) | Heat stability (%) |
|---|---|---|---|---|---|---|---|---|
| 53 | 60 | $TiO_2$ | 20 | 14 | 5 | 1 | more than 90 | +16 |
| 54 | " | $ZrO_2$ | " | " | " | " | " | +14 |
| 55 | " | $ThO_2$ | " | " | " | " | " | +18 |
| 56 | " | $V_2O_5$ | ;41 | " | ;41 | " | " | +19 |
| 57 | " | $Nb_2O_5$ | " | " | " | " | " | +17 |
| 58 | " | $Ta_2O_5$ | " | " | " | " | " | +17 |
| 59 | " | $La_2O_3$ | " | " | " | " | " | +16 |

In the present invention, when the above described resistor composition is used as a base component and 0.1–20 parts by weight based on 100 parts by weight of said base component, of at least one of the carbides of Ti, Zr, V, Nb, Ta, Cr, Mo, W, B and Th is compounded thereto, the control of the resistance value becomes easy and the heat stability can be further improved without deteriorating resistance to formation of the looseness of the center electrode against the impactive vibration test under heating.

When said amount is less than 0.1% by weight, the effect cannot be expected and when said amount exceeds 20% by weight, the durable life property under load is unexpectedly deteriorated and exceeds −30% and the resistance value becomes too small.

The following Table 4 shows the effect due to the addition of such carbides.

Table 4

| Sample No. | Composition (weight part) Boro-silicate glass | Resistance value stabilizing component $TiO_2$ | SiC | Water soluble carbonaceous material (methyl cellulose) | Higher melting point metal powder Fe | Lower melting point metal powder Sn | Carbide (weight part) | | Impactive vibration test under heating Time causing looseness in center electrode (min) | Durable life property under load (%) | heat stability (%) |
|---|---|---|---|---|---|---|---|---|---|---|---|
| 60** | 60 | 9 | 15 | 1 | 10 | 5 | (TiC) | 0 | more than 90 | +25 | +5.9 |
| 61 | " | " | " | " | " | " | (TiC) | 0.1 | " | +20 | +5.0 |
| 62 | " | " | " | " | " | " | (TiC) | 5 | " | −12 | +4.1 |
| 63 | " | " | " | " | " | " | (TiC) | 10 | " | −21 | +3.5 |
| 64 | " | " | " | " | " | " | (TiC) | 20 | " | −28 | +3.2 |
| 65 | " | " | " | " | " | " | (TiC) | 22* | " | −35* | +3.2 |
| 66 | " | " | " | " | " | " | (ZrC) | 5 | " | −13 | +4.0 |
| 67 | " | " | " | " | " | " | ($B^4C$) | 5 | " | −15 | +3.9 |
| 68 | " | " | " | " | " | " | ($Mo_2C$) | 5 | " | −11 | +4.2 |
| 69 | " | " | " | " | " | " | (WC) | 5 | " | −10 | +4.8 |
| 70 | " | " | " | " | " | " | (TaC) | 5 | " | −12 | +4.8 |
| 71 | " | " | " | " | " | " | (NbC) | 5 | " | −11 | +3.9 |
| 72 | " | " | " | " | " | " | (VC) | 5 | " | −4.8 | +4.5 |
| 73 | " | " | " | " | " | " | ($Cr_3C_2$) | 5 | " | −15 | +4.9 |

*Beyond the defined range. Not suitable.
**The same as Sample No. 1.

What is claimed is:

1. A self sealable glassy resistor composition for a resistor sealed spark plug consisting essentially of 5–40% by weight of at least one of the resistance value stabilizing component selected from the group consisting of oxides of metals of Groups IVb and Vb of the Periodic Table, $La_2O_3$, $ThO_2$ and SiC; a water soluble carbonaceous material selected from the group consisting of: sugar, lactose, maltose, raffinose, glucose, xylose, dextrine methyl cellulose, ethylene glycol, glycerine, propylene glycol, polyethylene glycol and polyvinyl alcohol, present in such an amount that 0.1–5.0% by weight of carbon value is contained in the final composition, 35–85% by weight of borosilicate glass powder, 5–25% by weight of at least one metal or alloy, the melting point of which is higher than the glass seal temperature, said metal or alloy being selected from the group consisting of: Fe, Fe—B, Fe—Ti, Cu, Ni, Cr, Mn and Ni—Cr, and 2–20% by weight of at least one metal or alloy, the melting point of which is lower than the glass seal temperature, said metal or alloy being selected from the group consisting of: Sn, Sb, Zn, Al, Pb, Te, Cu—Sn and Cu—Zn, provided that the total amount of both the higher melting point metal or alloy and the lower melting point metal or alloy is not greater than 30% by weight.

2. The resistor composition as claimed in claim 1, wherein 0.1–20 parts by weight, based on 100 parts by weight of the self sealable glassy resistor composition as claimed in claim 1, of at least one of carbides of Ti, Zr, V, Nb, Ta, Cr, Mo, W, B and Th are compounded thereto.

3. The resistor composition as claimed in claim 1, wherein the oxide of metals of Groups IVb and Vb of the Periodic Table is selected from the group consisting of: $TiO_2$, $ZrO_2$, $HfO_2$, $V_2O_5$, $Nb_2O_5$ and $Ta_2O_5$.

* * * * *